US005256529A

United States Patent [19]

Romanet et al.

[11] Patent Number: 5,256,529

[45] Date of Patent: Oct. 26, 1993

[54] SILVER HALIDE PHOTOGRAPHIC MATERIALS CONTAINING SULFONAMIDO-SOLUBILIZED PYRAZOLOTRIAZOLE COUPLERS

[75] Inventors: Robert F. Romanet; Hans G. Ling; David Hoke, all of Rochester, N.Y.

[73] Assignee: Eastman Kodak Company

[21] Appl. No.: 919,435

[22] Filed: Jul. 27, 1992

[51] Int. Cl.[5] ..... G03C 1/08; G03C 7/26; G03C 7/32

[52] U.S. Cl. ..... 430/558; 430/505; 430/544; 430/449; 430/955; 430/956; 430/957; 430/958; 430/959; 430/960; 430/387; 252/600

[58] Field of Search ..... 430/558, 449, 955, 965, 430/957, 958, 959, 960, 544, 505, 387; 252/600

[56] References Cited

U.S. PATENT DOCUMENTS 4,741,995 5/1988 Tani et al. ..... 430/558
4,762,775 9/1988 Ogawa et al. ..... 430/558
4,791,052 12/1988 Kida et al. ..... 430/558
4,835,094 5/1989 Wolff et al. ..... 430/558
4,865,963 9/1989 Furutachi et al. ..... 430/558
4,959,299 9/1990 Sakanone et al. ..... 430/955

FOREIGN PATENT DOCUMENTS 2091948 4/1987 Japan .

*Primary Examiner*—Charles L. Bowers, Jr.
*Assistant Examiner*—Geraldine Letscher
*Attorney, Agent, or Firm*—Foley & Lardner

[57] ABSTRACT

A magenta dye-forming pyrazolotriazole coupler solubilized by one or two sulfonamido groups results in a coupler having increased coupling activity, low fog and good dispersability. The couplers are useful in photographic elements and react with oxidized silver halide to form dyes, and/or to release photographically useful groups.

27 Claims, No Drawings

SILVER HALIDE PHOTOGRAPHIC MATERIALS CONTAINING SULFONAMIDO-SOLUBILIZED PYRAZOLOTRIAZOLE COUPLERS

BACKGROUND OF THE INVENTION

This invention relates to silver halide photographic materials, in particular to magenta dye-forming pyrazolotriazole couplers useful in silver halide photographic materials, and more particularly to pyrazolotriazole couplers which have increased coupler activity as compared to conventional pyrazolotriazole couplers, while having low fog and good dispersability.

Pyrazolotriazole couplers are known to be useful for forming color images in photographic silver halide materials. While these couplers provide good hues, they suffer from a number of problems. Particularly, the photographic activities of these couplers tend to be low. The coupling activity of an image coupler in a photographic film is a measure of its coupling rate with oxidized developer during the silver development stage. In a color negative film, a rapid rate of depletion of image coupler results in lower granularity, which is a desirable trait for fast layer applications.

It is known to improve this activity by attaching a water soluble carboxyl group to the pyrazolotriazole. See, for example, U.S. Pat. Nos. 4,835,094 and 4,791,052. The carboxy-solubilized pyrazolotriazole couplers show improved activity, but tend to be difficult to disperse during the coating process. It is important to have a coupler with good dispersion during the film/paper manufacture as well as for photographic performance. A stable, fine dispersion reduces melt-hold problems during coating operation, producing uniform products with no detectable dispersion granularity. Furthermore, these couplers undesirably give high silver fog during processing. Silver fog or chemical fog is the phenomenon which occurs when silver grains are developed during development in the area that has received no exposure of light. This often causes higher minimum density, higher low-scale granularity, and lower method photographic speed.

It is further known to use sulfonamide solubilizing groups with pyrazolotriazole couplers. See U.S. Pat. No. 4,865,963. However, these couplers are not very active.

Hence there is a need to find a magenta image dye-forming pyrazolotriazole coupler which has high activity, good dispersability, and which gives low fog during development.

SUMMARY OF THE INVENTION

These and other needs have been satisfied by providing, in accordance with one aspect of the invention, a magenta image dye-forming pyrazolotriazole coupler useful in a photographic element having the structure

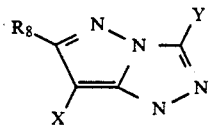

wherein

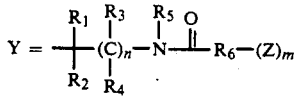

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$R_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that if m is 2 then the Z groups are present meta to each other;

$R_8$ is a substituted or unsubstituted alkyl group, or a substituted or unsubstituted aryl group, and X is hydrogen, or a coupling off group which may include a photographically useful group.

There is further provided a molecule having the structure $$COUP—(TG)_n—PUG$$

wherein COUP is a magenta dye-forming coupler as claimed in claim 1,

TG is a timing group, cleavable from COUP during processing, n is 0, 1, 2, or 3, and PUG is a releasable photographically useful group.

There is further provided in accordance with the present invention, a silver halide emulsion having associated therewith a pyrazolotriazole coupler and/or a molecule as described above.

There is also provided in accordance with the invention, a photographic element comprising a support and a silver halide emulsion layer having associated therewith a coupler and/or a molecule having the structure described above. There is further provided a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye forming coupler, wherein the element further comprises a coupler and/or a molecule having the above structure.

There is also provided a process for developing an image in a photographic element comprising a support and a silver halide emulsion containing an image-wise distribution of developable silver halide grains, said process comprising the step of developing said element with a silver halide color developing agent in the presence of a coupler and/or a molecule having a structure described above.

Further objects, features, and advantages of the present invention will become apparent from the detailed description of preferred embodiments that follows.

DETAILED DESCRIPTION OF THE PREFERRED EMBODIMENTS

The invention relates to a novel pyrazolotriazole coupler, and the use of such a coupler in photographic elements. The coupler is a pyrazolo(3,2-c)-s-triazole having sulfonamide solubilization in the 3 position. The coupler is represented by the following structure I.

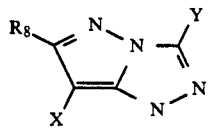

wherein

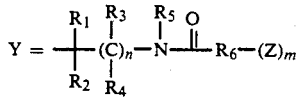

and $R_1$, $R_2$, $R_3$, $R_4$ and $R_5$ are independently hydrogen, substituted or unsubstituted alkyl groups, or substituted or unsubstituted aryl groups, preferably one of $R_1$ and $R_2$ is other than hydrogen, n is 0, 1, 2, 3, or 4;

$R_6$ is a substituted or unsubstituted arylene or substituted or unsubstituted heterocyclic group;

Z is $—NHSO_2—R_7$;

$R_7$ is an n-alkyl group containing 1 to 4 carbon atoms, an unsubstituted phenyl or a phenyl substituted with neutral (that is, having positive Hammett sigma values) or electron withdrawing groups, or a heterocyclic group which may be unsubstituted or substituted with a neutral or electron withdrawing group; m is 1 or 2, with the proviso that if m is 2 then the Z groups are present meta to each other;

$R_8$ is a substituted or unsubstituted alkyl group, or a substituted or unsubstituted aryl group, and X is hydrogen, or a coupling off group (COG) which may include a photographically useful group (PUG).

By a COG is meant a group which can be cleaved during the development process, with, for example, oxidized color developer.

$R_8$ may be any known alkyl or aryl group, and may be substituted with one or more substituents which do not adversely affect the reaction of the coupler during processing. When $R_8$ is an alkyl group it is particularly preferred for the alkyl to contain 1–8 carbon atoms, more preferably a straight-chain or branched alkyl group having 1 to 4 carbon atoms. When $R_8$ is an aryl group, it is preferably a phenyl group, which may optionally be substituted with one or more substituents selected from alkyl, alkoxy, halogen, carbonamido, or alkoxycarbonyl or other substituents which do not adversely affect the reaction of the coupler during processing. $R_8$ may also be an alkyl group interrupted by oxygen linkages. $F_8$ is most preferably a methyl group.

X is preferably hydrogen, or a halogen atom, such as chlorine.

$R_6$ is preferably a phenylene group, but may also be a heterocyclic group, preferably containing 5 or 6 ring members, with one or more N, S, and/or 0 heteroatoms, such as a pyridyl, imidazolyl, and benzimidazolyl. Suitable substituents for $F_6$ include halogen, alkoxy, alkyl, aryl, nitro, cyano, and alkoxycarbonyl. It is most preferred for $R_6$ to be an unsubstituted phenylene group.

Suitable electron withdrawing substituents when $R_7$ is an aryl or heterocylic group include any known in the art such as Cl, $NO_2$, CN, $SO_2$, $SON(R)_2$, $CON(R)_2$, $COR_2R_9$, wherein R is hydrogen, or an alkyl or aryl group; and $R_9$ is alkyl or aryl group. Suitable neutral substituents when $R_7$ is an aryl or heterocylic group include any known in the art, including $CO_2H$ and hydrogen. $R_7$ is preferably a methyl group.

$R_5$ is preferably an alkyl group having 1 to 32 carbon atoms, or an aryl group which may be substituted.

$R_1$ is preferably a methyl or phenyl group.

It is preferred for n to be 0. If n is 0, then $R_3$ and $R_4$ are not present. If n is 1, 2, 3, or 4, then $R_3$ and $R_4$ are preferably selected from alkyl groups having 1 to 30 carbon atoms, or an aryl group which may optionally be substituted.

Suitable substituents for the $R_1$ and $R_5$ groups include any known in the art which will not adversely affect the coupler during processing.

Examples of couplers within the scope of the present invention include the following:

Coupler 1.

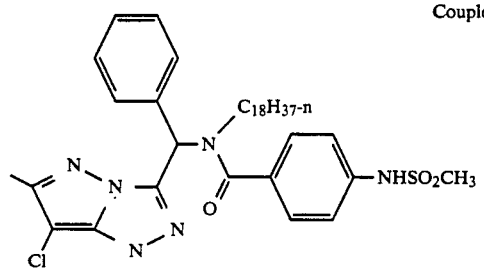

Coupler 2.

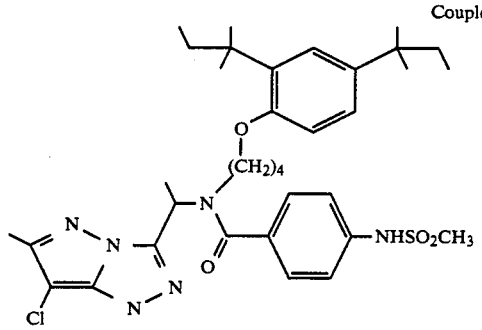

Coupler 3.

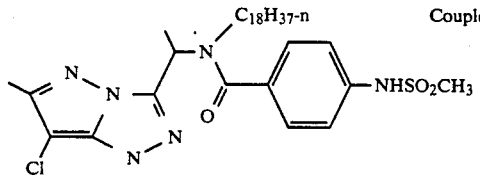

-continued

Coupler 4.

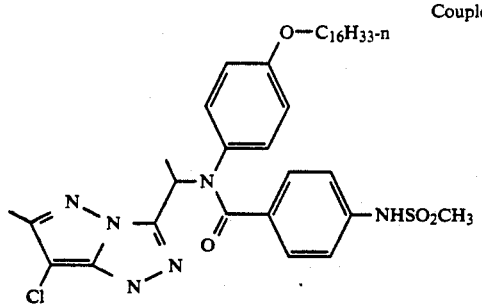

The pyrazolotriazole couplers according to the invention can be prepared by the general methods of synthesis described in the art, such as in Research Disclosure, Aug. 1974, Item No. 12443, published by Kenneth Mason Publications, Ltd., The Old Harbourmaster's, 8 North Street, Emsworth, Hampshire P010 7DD, England and U.S. Pat. No. 4,540,654.

Coupler 1 was prepared according to the procedure outlined below which is represented by the schematic which follows:

78ml (0.0225 moles) methane sulfonyl chloride (S-2) was added to a stirred suspension of 33g (0.20 moles) of ethyl p-aminobenzoate (S-1) and 18ml (0.0225 moles) pyridine and 0.38g (0.004 moles) pyridine N-oxide in 100ml isopropyl alcohol. The reaction mixture exotherms to about 50° C. After stirring at ambient temperature for ½ hour, a solution of 40g (1 mole) sodium hydroxide in 150ml water was added, and the reaction mixture was refluxed for ½ hour. The reaction mixture was poured into a seperatory funnel and allowed to cool to room temperature. The aqueous layer that separated (180ml) was diluted to 400ml with ice water, and concentrated hydrochloric acid was added until the mixture was strongly acidic (pH=2). The white precipitate was filtered off, washed with water, and air dried to give 40.8 g of compound S-4.

13 ml (0.15 moles) oxalyl chloride and 0.5ml N,N-Dimethylformamide were added to a suspension of 21.5g (0.10 moles) of compound S-4 in 100ml ethyl acetate, and a vigorous evolution of bubbles was observed. The mixture was stirred for 1.5 hours at ambient temperature and a white insoluble solid was still observed. 200ml hexane was added, and 20g of S-5 was filtered off as a white solid.

Pyrazolatriazole S-8 was dissolved in 600ml acetic acid and 61 g (0.724 moles) sodium acetate was added, followed by the drop-wise addition (over ½ an hour) of 21.8ml (0.307 moles) of acetyl chloride. The mixture was stirred at ambient temperature for ½ hour, and the reaction mixture became very thick with a precipitate. The reaction mixture was poured into a seperatory funnel and washed with water and then saturated $NaHCO_3$ until all of the acetic acid was removed. It was then concentrated to a gummy solid, and purified by dissolving it in dichloromethane and passing it through a pad of silica gel, concentrating it to an oil, and then crystallizing it from acetonitrile to give 61g of S-9 as a white solid.

A suspension of 16g (0.0287 moles) of S-9 in 300ml ethyl acetate was warmed to about 40° C. until solution was complete. After allowing the solution to cool to room temperature, 10.9ml (0.0862 moles) N,N-dimethylaniline and 8.7g (0.0373 moles) of freshly prepared acid chloride S-5 was added. The reaction mixture was stirred at ambient temperature for 16 hours. The reaction mixture was poured into a seperatory funnel and washed with 1×200ml 10%HCl, 3×200ml saturated $NaHCO_3$ solution, 1×200ml 10% HCl and finally 1×100ml brine. The resulting compound was concentrated to a yellow gum and then crystallized from acetonitrile to yield 17.2g of S-10 as a light tan solid.

2.1ml (0.0247 moles) of concentrated HCl was added to a suspension of 6.2g (0.0082 moles) of compound S-10 in 40ml methanol. The mixture was heated to reflux for about 5 minutes as complete solution takes place. It was then cooled to room temperature, and 40ml water was added The solution was extracted with 3×20ml ethyl acetate. The combined ethyl acetate extracts were washed with 1×20ml brine, dried with $Na_2SO_4$, and concentrated to a glass. The product was crystallized from acetonitrile to give 5.4g of Compound S-11, Coupler 1, as a white solid. The identity of the product was confirmed by elemental analysis, NMR, end mass spectra.

Preparation of Coupler 1

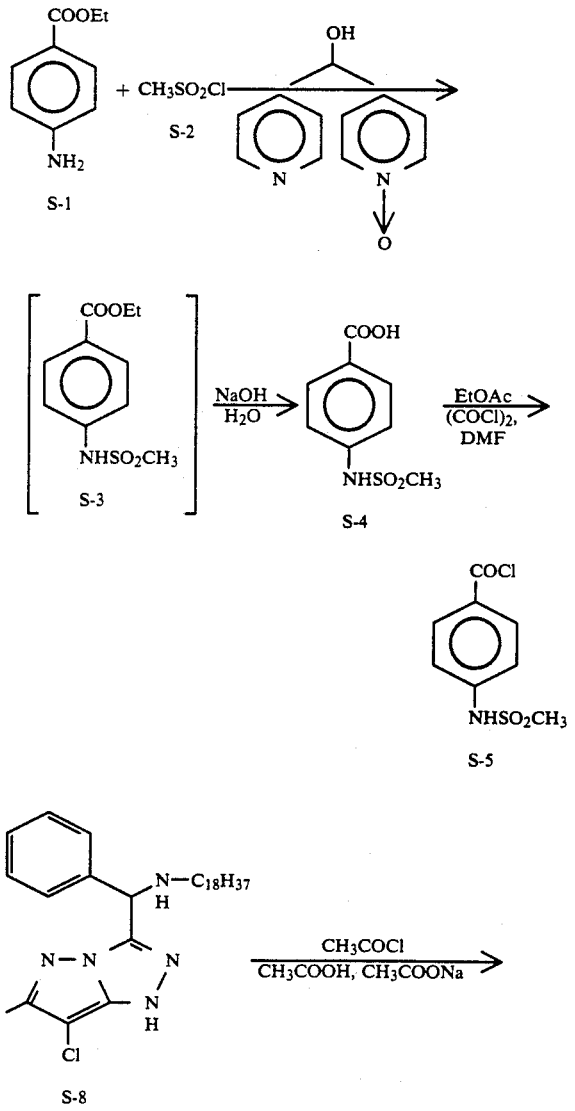

-continued

Preparation of Coupler 1

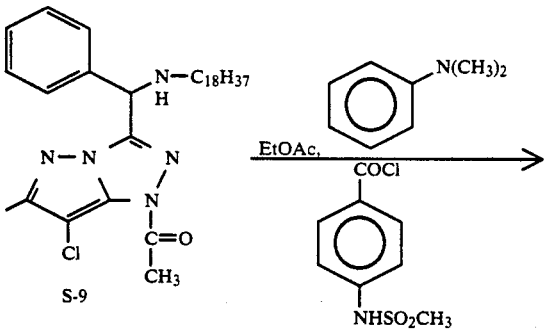

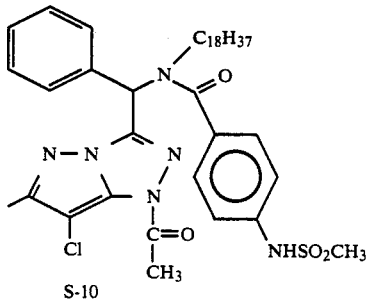

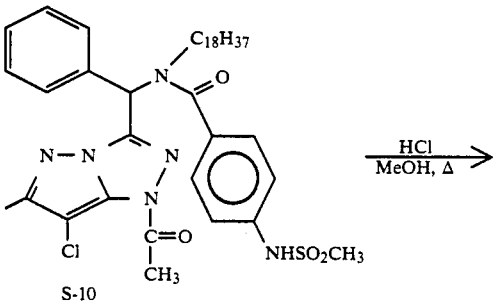

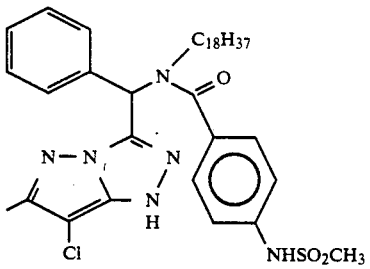

S-11
COUPLER 1

The invention also relates to the use of the above described couplers in molecules from which photographically useful groups can be released. Such molecules are of the structure II $$\text{COUP}—(\text{TG})_n—\text{PUG} \qquad \text{II}$$

wherein COUP is a magenta dye-forming coupler as described above,

TG is a timing group, cleavable from COUP during processing, n is 0, 1, 2, or 3, and PUG is a releasable photographically useful group.

Any timing group which is known in the photographic art is useful as the timing groups TG. One or more timing groups can be used. Exemplary timing groups are disclosed in U.S. Pat. Nos. 4,248,962, 4,772,537, 5,019,492, and 5,026,628 and European Patent Application No. 255,085. Up to 3 timing groups can be joined sequentially (that is, n is 0 to 3). The timing group can be unballasted or ballasted, and can contain solubilizing groups.

The ballast can be any group of sufficient size and bulk that, with the remainder of the molecule, renders the unreacted molecule immobile or non-diffusible in the film element prior to processing. It can be a relatively small group if the remainder of the group is relatively bulky. Preferably, the ballast is an alkyl or aryl group, each containing about 8 to 30 carbon atoms. These groups can be substituted or unsubstituted with groups which, for example, enhance the nondiffusability of the coupler prior to development. A ballast can be attached in any way to the TG and/or to COUP. The ballast can also contain additional solubilizing groups such as carboxylic acids or sulfonamides. Suitable ballast groups are described in, for example, U.S. Pat. Nos. 4,420,556 and 4,923,789, which are incorporated herein by reference.

Useful PUGs include any known in the art, such as development inhibitors, dyes, dye precursors, couplers, developing agents, development accelerators, bleach inhibitors, bleach accelerators, stabilizers, nucleators, fixing agents, complexing agents, image toners, image stabilizers, tanning agents, solvents, surfactants, chemical and spectral sensitizers, hardeners, fogging agents, antifoggants, UV absorbers and stabilizers, and other additives known to be useful in photographic materials. These PUGs are well known in the art, and are described, for example, in U.S. Pat. Nos. 5,019,492 and 5,026,628, which are both herein incorporated by reference in their entireties.

The novel couplers of the present invention can be used as masking couplers in a layer of a photographic material. Masking couplers are compounds which mask a layer of a photographic element from unwanted wavelengths of light. When used as a masking coupler, a molecule having the above structure II is used wherein PUG is a dye. The type of dye is selected, as is known, so as to facilitate the desired masking. The dye may be attached to TG, or to COUP if n is zero, at any location except through the auxochrome of the dye. The auxochromic group of the dye may be blocked by any removable group known in the art. The hue shift can then be controlled by blocking and unblocking the dye, so that the desired masking effect is obtained without the absorption of unwanted light which often results in a speed loss in the color of the absorbed light. The blocking group may be any group which is removable during processing. Examples of useful blocking groups are disclosed in UK Patent Application 2,105,482, with particularly effective blocking groups described in U.S. Pat. No. 5,019,492 which is incorporated herein by reference in its entirety.

The couplers of structure I and the molecules of structure II can be incorporated in silver halide emulsions and the emulsions can be coated on a support to form a photographic element.

Alternatively or additionally, the coupler and/or a molecule can be incorporated in the photographic element adjacent to the silver halide emulsion where, during development, the coupler and/or a molecule will be in reactive association with development products such as an oxidized color developing agent. More than one of the couplers and/or molecules may be present in a single layer of a film, or throughout the film.

The term associated used in the instant specification means that the coupler is either incorporated in a silver halide layer or incorporated in a photographic element, such that during development the coupler will be able to react with development products such as an oxidized color developing agent.

The photographic elements in which the couplers and molecules of this invention are employed can be either single color or multi-color elements. Multi-color elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. When used as a masking coupler, the coupler is located in a layer of the film which is intended to be masked.

A typical multi-color photographic element comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements according to the invention, reference will be made to Research Disclosure, Dec. 1989, Item 308119, published by Kenneth Mason Publications, Ltd., Emsworth, Hampshire P010 7DQ, U.K., the disclosures of which are incorporated herein in their entireties by reference. This publication will be identified hereafter as "Research Disclosure". The elements of the invention can comprise emulsions and additives described in these publications and publications referenced therein.

The silver halide emulsions employed in the elements according to the invention can comprise silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed by Mignot, U.S. Pat. No. 4,386,156; Wey, U.S. Pat. No. 4,399,215; Maskasky, U.S. Pat. No. 4,400,463; Wey et al., U.S. Pat. No. 4,414,306; Maskasky, U.S. Pat. No. 4,414,966; Daubendiek et al., U.S. Pat. No. 4,424,310; Solberg et al., U.S. Pat. No. 4,433,048; Wilgus et al., U.S. Pat. No. 4,434,226; Maskasky, U.S. Pat. Nos. 4,435,501; Evans et al., U.S. Pat. No. 4,504,570; and Daubendiek et al., U.S. Pat. Nos. 4,672,027 and 4,693,964. Also specifically contemplated are those silver bromoiodide grains with a higher molar proportion of iodide in the core of the grain than in the periphery of the grain, such as those described in U.K. Pat. No. 1,027,146; Japanese Patent 54/48521; U.S. Pat. Nos. 4,379,837; 4,444,877; 4,565,778; 4,636,461; 4,665,012; 4,668,614; 4,686,178; and 4,728,602; and in European Patent 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, noble metal (for example, gold), middle chalcogen (such as sulfur, selenium or tellurium), and reduction sensitizers, employed individually or in combination, are specifically contemplated. Typical chemical sensitizers are listed in Research Disclosure, Item 308119, Section III.

The silver halide emulsions can be spectrally sensitized with dyes from a variety of classes, including the polymethine dye class, which includes the cyanines, merocyanines, complex cyanines and merocyanines (such as tri-, tetra- and polynuclear cyanines and merocyanines), oxonols, hemioxonols, styryls, merostyryls and streptocyanines. Illustrative spectral sensitizing dyes are described in Research Disclosure, Item 308119, Section IV and the publications cited therein.

Suitable vehicles for the emulsion layers and other layers of the elements according to the invention are described in Research Disclosure, Item 308119, Section IX and the publications cited therein.

The photographic elements according to the invention can include additional couplers such as those described in Research Disclosure Section VII, paragraphs D-G and the publications cited therein. These additional couplers can be incorporated as described in Research Disclosure Section VII, paragraph C and the publications cited therein. The coupler according to the invention can be used with colored masking couplers such as described in U.S. Pat. No. 4,883,746, with image modifying couplers such as described in U.S. Pat. Nos. 3,148,062; 3,227,554; 3,733,201; 4,409,323; and 4,248,962 and with couplers that release bleach accelerators such as described in European Patent Application 193,389.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can be coated on a variety of supports as described in Research Disclosure Section XVII and the references cited therein. These supports include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. The oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)-ethylaniline sulfatehydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N (2-methoxyethyl)-m-toluidine-di-p-toluenesulfonic acid.

With negative-working silver halide, the process step described above leads to a negative image. The described elements are preferably processed in the known C-41 color process as described in, for example, the British Journal of Photography Annual of 1988, pages 196–198. To obtain a positive (or reversal) image, the color development step can be preceded by development with a non-chromogenic developing agent to develop exposed silver halide but not form dye, and then uniformly fogging the element to render unexposed silver halide developable, followed by development with a chromogenic developer. Alternatively, a direct-positive emulsion can be employed to obtain a positive image.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

A coupler having the structure 1 set forth above was compared with the following solubilized pyrazolotriazole couplers 5–7:

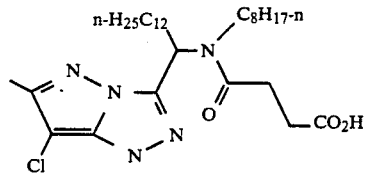

Coupler 5.

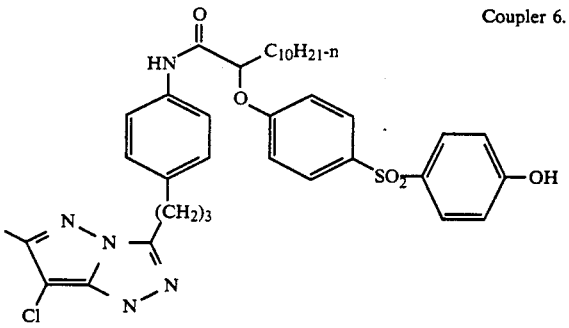

Coupler 6.

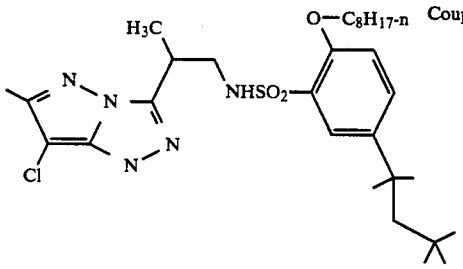

Coupler 7.

The following development inhibitor releasing (DIR coupler) was used in the Examples of Table 2.

DIR-1.

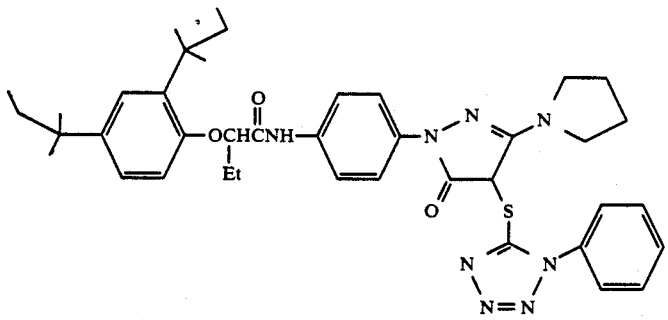

Couplers 1 and 5-7 were coated in a single layer format and compared. The coating format was as follows, wherein coating format 1 was used for the data in Table 1, and coating format 2 was used for the data for Table 2.

Coating format 1:

The following layers were coated on a cellulose triacetate film support (coverage is in g/m$^2$):

Layer 1 (Antihalation Layer): Black colloidal silver sol containing 0.323g/m$^2$ of silver and 2.691g/m$^2$ gelatin.

Layer 2 (Magenta Imaging Layer): Green-sensitized tabular silver iodobromide emulsion (3.0 mole % iodide) at 0.877g/m$^2$ with 665.4μmol/m$^2$ of the tested magenta image coupler, gelatin at 2.412g/m$^2$, and 4-hydroxy-6-methyl-1,3,3a,7-tetraazaindene at 0.036g/m$^2$.

Layer 3 (Protective Overcoat): Gelatin at 4.39g/m$^2$ and bis-vinylsulfonyl methane added at 1.75% of total gelatin weight.

Coating Format 2:

This format was the same as Coating Format 1 except that 22.33μmol/m$^2$ of DIR-1 was added to Layer 2.

The coatings were processed as follows:

The tested coatings were processed in the C-41 Process to obtain status-M desitometry. It is from these desitometric curves that speed and contrast are derived. In the case of silver data, a C–41 Process without a bleach bath was used. The silver data of these processed strips were measured by X-ray flouresence in triplicate. The silver data were averaged to calculate the speed and contrast.

When a relative rate of image couplers are compared, they are obtained by HPLC extraction of the processed strips with step exposures. The rate of the usage of the image coupler was compared to the rate of the usage of the common DIR-1.

The results are shown in Tables 1 and 2 which follow. With the inventive coupler 5 which contains carboxy Relative to the coupler 5 which contains carboxy solubilization, coupler 1 shows lower silver fog. Coupler 1 is also more dispersable then the other couplers, since it is soluble in ethyl acetate and amenable to evaporated dispersions. There is less silver inhibition (that is, higher speed) with coupler 1 as compared to coupler 6. Compared with coupler 7, which is a sulfonamido solubilized pyrazolotriazole disclosed in U.S. Pat. No. 4,865,963, coupler 1 is more reactive and has higher speed, as seen in Table 2.

TABLE 1

| COUPLER NO. | Ag Dmin mean u mole/m2 | Ag CONTRAST | SPEED |
|---|---|---|---|
| 1 | 37.02 | 2.68 | 263 |

TABLE 1-continued

| COUPLER NO. | Ag Dmin mean u mole/m2 | Ag CONTRAST | SPEED |
|---|---|---|---|
| 5 | 52.1 | 2.54 | 272 |
| 6 | 4.52 | 2.15 | 250 |

TABLE 2

| COUPLER NO. | SPEED | CONTRAST | RELATIVE RATE |
|---|---|---|---|
| 1 | 254 | 1.60 | 0.25 |
| 7 | 235 | 0.59 | 0.04 |

Compared with known pyrazolotriazole couplers, compounds of the present invention shown an increased activity. Furthermore, unlike other methods of increasing activity, such as incorporating carboxy solubilization, compounds of the invention do not lead to higher silver fog or dispersability problems. In addition, these compounds have good hue and low silver inhibition.

The invention has been described in detail with particular reference to preferred embodiments thereof, but it will be understood that variations and modifications can be effected within the spirit and scope of the invention.

What is claimed is:

1. A photographic element comprising a support and a silver halide emulsion layer having associated therewith a magenta dye-forming coupler having the structure

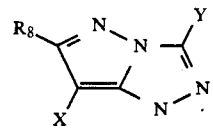

wherein

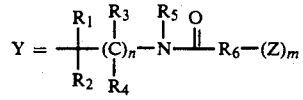

and $R_1$, $R_2$, $R_3$, and $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is —$NHSO_2$-$R_7$;

$R_7$ is an n-alkyl group containing 1 to 4 carbon atoms, an unsubstituted phenyl or a phenyl substituted with neutral or electron withdrawing groups, or a heterocyclic group with may be unsubstituted of substituted with a neutral or electron withdrawing group;

m is 1 or 2, with the proviso that if m is 2 then the Z groups are present meta to each other;

$R_8$ is a substituted or unsubstituted alkyl group, or a substituted or unsubstituted aryl group, and X is hydrogen, or a coupling off group which may include a photographically useful group.

2. A photographic element as claimed in claim 1, wherein one of $R_1$ and $R_2$ is other than hydrogen.

3. A photographic element as claimed in claim 2, wherein $R_8$ is a methyl group.

4. A photographic element as claimed in claim 1, wherein X is a halogen or hydrogen atom.

5. A photographic element as claimed in claim 1, wherein $R_6$ is a phenylene group.

6. A photographic element as claimed in claim 1, wherein n is 0.

7. A photographic element as claimed in claim 6, wherein $R_1$ is a methyl or phenyl group and $R_2$ is hydrogen.

8. A photographic element as claimed in claim 1, wherein the coupler is selected from the group consisting of

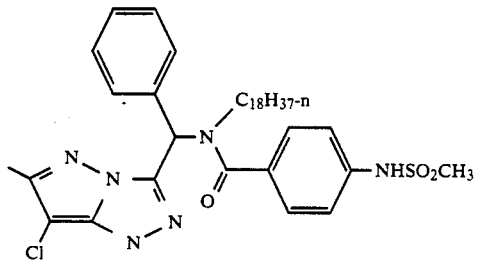

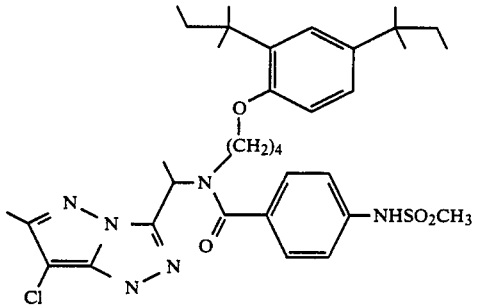

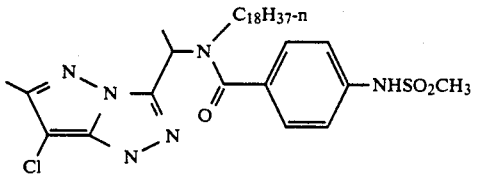

and

-continued

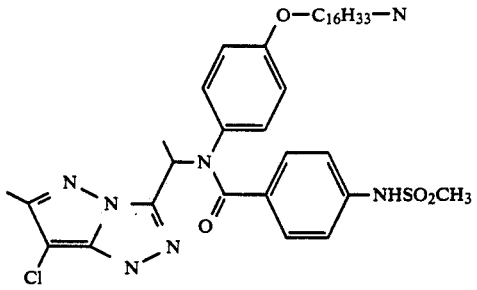

9. A photographic element comprising a support and a silver halide emulsion layer having associated therewith a molecule having the structure $$—COUP—(TG)_n—PUG$$

wherein COUP is a magenta dye-forming coupler having the structure

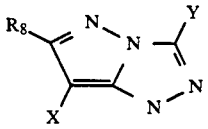

wherein

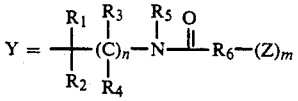

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$KR_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that if m is 2 then the Z groups are present meta to each other;

$R_8$ is a substituted or unsubstituted alkyl group, or a substituted or unsubstituted aryl group, X is $(TG)_n$-PUG, TG is a timing group, cleavable from COUP during processing, n is 0, 1, 2, and 3, and PUG is a releasable photographically useful group,

10. A multi-color photographic element comprising a support bearing a cyan dye image-forming unit comprising at least one red-sensitive silver halide emulsion layer having associated therewith at least one cyan dye-forming coupler, a magenta dye image forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye forming coupler, wherein the element further comprises a magenta dye-forming coupler having the structure

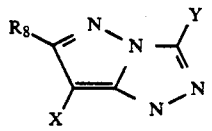

wherein

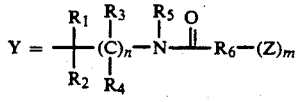

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$R_7$ is an n-allyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group; m is 1 or 2, with the provide that if m is 2 then the Z groups are present meta to each other;

$R_8$ is a substituted or unsubstituted alkyl group, or a substituted or unsubstituted aryl group, and X is hydrogen, or a coupling off group which may include a photographically useful group.

11. A multi-color photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye forming coupler, wherein the element further comprises a molecule having the structure $COUP—(TG)_n—PUG$ wherein COUP is a magenta dye-forming coupler having the structure

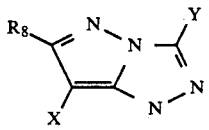

wherein

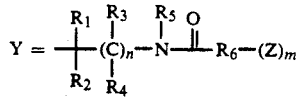

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$R_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that if m is 2 then the Z groups are present meta to each other;

$R_8$ is a substituted or unsubstituted alkyl group, or a substituted or unsubstituted aryl group, X is $(TG)_n$-PUG TG is a timing group, cleavable from COUP during processing, n is 0, 1, 2, or 3, and PUG is a releasable photographically useful group.

12. A process for developing an image in a photographic element comprising a support and a silver halide emulsion containing an image-wise distribution of developable silver halide grains, said process comprising the step of developing said element with a silver halide color developing agent in the presence of a megenta dye-forming coupler having the structure

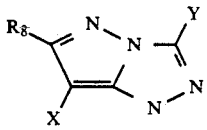

wherein

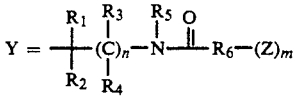

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is substituted or unsubstituted arylene or substituted or unsubstituted heterocyclic group;

Z is $—NHYSO_2—R_7$;

$R_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that if m is 2 then the Z groups are present meta to each other;

$R_8$ is a substituted or unsubstituted alkyl group, or a substituted or unsubstituted aryl group, and X is hydrogen, or a coupling off group which may include a photographically useful group.

13. A process for developing an image in a photographic element comprising a support and a silver halide emulsion containing an image-wise distribution of developable silver halide grains, said process comprising the step of developing said element with a silver halide color developing agent in the presence of a molecule having the structure COUP—$(TG)_n$—PUG, wherein COUP is a magenta dye-forming coupler having the structure

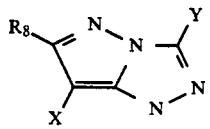

wherein

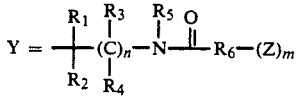

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$R_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that if m is 2 then the Z groups are present meta to each other;

$R_8$ is a substituted or unsubstituted alkyl group, or a substituted or unsubstituted aryl group, X is $(TG)_n$-PUG TG is a timing group, cleavable from COUP during processing, n is 0, 1, 2, or 3, and PUG is a releasable photographically useful group.

14. A photographic silver halide emulsion containing a coupler having the structure

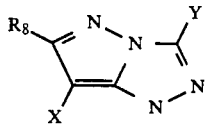

wherein

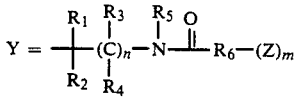

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$R_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that if m is 2 then the Z groups are present meta to each other;

$R_8$ is a substituted or unsubstituted alkyl group, or a substituted or unsubstituted aryl group, and X is hydrogen, or a coupling off group which may include a photographically useful group.

15. A photographic silver halide emulsion containing a molecule having the structure COUP—$(TG)_n$—PUG wherein COUP is a magenta dye-forming coupler having the structure

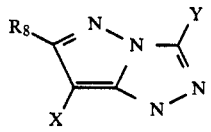

wherein

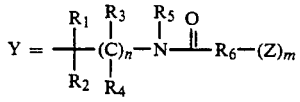

and $R_1$, $R_2$, $R_3$, $R_4$ and $R_5$ are independently hydrogen, substituted or unsubstituted alkyl groups, of substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$R_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that is m is 2 then the Z groups are present meta to each other;

$R_8$ is a substituted or unsubstituted alkyl group, or a substituted or unsubstituted aryl group, and X is $(TG)_n$—PUG——.

16. A photographic element comprising a support and a masking coupler having the structure COUP—$(TG)_n$—DYE wherein COUP is a coupler having the structure

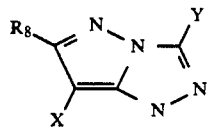

wherein

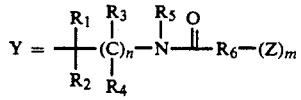

and $R_1$, $R_2$, $R_3$, $R_4$ and $R_5$ are independently hydrogen, substituted or unsubstituted alkyl groups, or substituted or unsubstituted aryl groups;

n is 0, 1, 2, 3, or 4;

$R_6$ is a substituted or unsubstituted arylene or substituted or unsubstituted heterocyclic group;

Z is $—NHSO_2—R_7$;

$R_7$ is an n-alkyl group containing 1 to 4 carbon atoms, an unsubstituted phenyl or a phenyl substituted with neutral or electron withdrawing groups, or a heterocyclic group which may be unsubstituted or substituted with a neutral or electron withdrawing group;

m is 1 or 2, with the proviso that if m is 2 then the Z groups are present meta to each other;

$R_8$ is substituted or unsubstituted alkyl group, or a substituted or unsubstituted aryl group, X is $(TG)_n$—DYE TG is a timing group, cleavable from COUP during processing, n is 0, 1, 2, or 3, and DYE is a dye.

17. A photographic element as claimed in claim 1, wherein $R_7$ is an n-alkyl group containing 1 to 4 carbon atoms.

18. A photographic element as claimed in claim 1, wherein n is 1, 2, 3, or 4, and wherein one of $R_3$ and $R_4$ is other than hydrogen.

19. A photographic element as claimed in claim 1, wherein $R_5$ is an alkyl group having 1 to 32 carbon atoms or an optionally substituted aryl group.

20. A photographic element as claimed in claim 5, wherein $R_6$ is an unsubstituted phenylene group.

21. A photographic element as claimed in claim 1, wherein $R_7$ is an optionally substituted heterocyclic group.

22. A photographic element as claimed in claim 1, wherein $R_6$ is an optionally substituted heterocyclic group.

23. A photographic element as claimed in claim 1, wherein $R_7$ is an unsubstituted phenyl group.

24. A photographic element as claimed in claim 1, wherein $R_7$ is a phenyl group substituted with an electron withdrawing group.

25. A photographic element as claim in claim 1, wherein $R_7$ is a phenyl group substituted with a neutrai substituent.

26. A photographic element as claimed in claim 1, wherein m is 2.

27. A photographic element as claimed in claim 1, wherein a developing inhibitor releasing coupler is associated with the silver halide emulsion.

* * * * *

UNITED STATES PATENT AND TRADEMARK OFFICE

CERTIFICATE OF CORRECTION

PATENT NO. : 5,256,529 Page 1 of 2

DATED : October 26, 1993

INVENTOR(S) : Robert F. Romanet et al

It is certified that error appears in the above-indentified patent and that said Letters Patent is hereby corrected as shown below:

In Column 14, Line 62, "$R_3$, and $R_4$" should read --$R_3$, $R_4$--.

In Column 15, Line 4, "of" should read --or--.

In Column 16, Line 45, "$KR_7$" should read --$R_7$--.

In Column 16, Line 58, "2, and 3," should read --2, or 3,--.

In Column 16, Line 64, "image forming" should read --image-forming--.

In Column 17, Line 29, "allyl" should read --alkyl--.

In Column 17, Line 35, "provide" should read --proviso--.

In Column 17, Line 37, remove the indent before statement beginning "$R_8$".

In Column 18, Line 58, after "is" insert --a--.

In Column 18, Line 60, "-$NHYSO_2$-$R_7$" should read --$NHSO_2$-$R_7$--.

In Column 20, Line 45, "of" should read --or--.

In Column 20, Line 58, second occurrence of "is" should read --if--.

UNITED STATES PATENT AND TRADEMARK OFFICE

CERTIFICATE OF CORRECTION

PATENT NO. : 5,256,529

DATED : October 26, 1993

INVENTOR(S) : Robert F. Romanet et al

It is certified that error appears in the above-indentified patent and that said Letters Patent is hereby corrected as shown below:

In Column 20, Line 62, after "PUG" remove "--".

Signed and Sealed this

Twelfth Day of July, 1994

Bruce Lehman

*Attest:*

BRUCE LEHMAN

*Attesting Officer*

*Commissioner of Patents and Trademarks*